US005899395A

United States Patent [19]

Deklerow

[11] Patent Number: 5,899,395

[45] Date of Patent: May 4, 1999

[54] MULTIPURPOSE FLUORESCENT LAMP CRUSHER

[75] Inventor: Joseph W. Deklerow, Rochester, N.Y.

[73] Assignee: Dextrite, Inc., Rochester, N.Y.

[21] Appl. No.: 08/871,802

[22] Filed: Jun. 9, 1997

[51] Int. Cl.[6] ..... B02C 13/288

[52] U.S. Cl. ..... 241/36; 241/37.5; 241/99; 241/100

[58] Field of Search ..... 241/99, 36, 37.5, 241/100, 186.1

[56] References Cited

U.S. PATENT DOCUMENTS

| | | | |
|---|---|---|---|
| 3,845,905 | 11/1974 | Haslberger | 241/186.1 X |
| 3,907,216 | 9/1975 | MacKissic et al. | 241/186.1 X |
| 4,655,404 | 4/1987 | Deklerow | 241/99 |
| 4,690,339 | 9/1987 | Schultz | 241/186.1 X |
| 4,819,883 | 4/1989 | Weil et al. | 241/99 |
| 5,076,505 | 12/1991 | Petrocy | 241/99 |
| 5,205,497 | 4/1993 | Deklerow | 241/99 X |
| 5,390,863 | 2/1995 | Tondo | 241/100 X |
| 5,492,278 | 2/1996 | Raboin | 241/99 X |
| 5,522,556 | 6/1996 | Knepler et al. | 241/36 X |
| 5,575,429 | 11/1996 | Muller-Girard | 241/99 X |

FOREIGN PATENT DOCUMENTS

| | | | |
|---|---|---|---|
| 1325557 | 3/1963 | France | 241/186.1 |
| 742911 | 10/1943 | Germany | 241/186.1 |

*Primary Examiner*—Joseph J. Hail, III
*Assistant Examiner*—William Hong
*Attorney, Agent, or Firm*—Shlesinger, Fitzsimmons & Shlesinger

[57] ABSTRACT

A lamp crusher housing is mounted on a wheeled rack selectively to have its lower, discharge end connected to the upper end of any one of a plurality of waste drums. Several lamp supply chutes are secured at their lower ends in registry with access openings formed in a cover that is secured over the upper end of the housing so that lamps dropped through the chutes pass into the path of lamp crusher members that rotate in the housing. Toxic gases released in the housing are withdrawn from the housing through a filter element by a vacuum pump or suction fan which communicates with the housing interior and the lower ends of the feed chutes. Flexible baffle elements in the chutes prevent glass fragments and any vortex from backing up from the housing into the chutes; and a pivotal deflector plate in one of the chutes guides smaller lamps into the path of the rotating crusher blades.

19 Claims, 2 Drawing Sheets

MULTIPURPOSE FLUORESCENT LAMP CRUSHER

BACKGROUND OF THE INVENTION

This invention relates to a fluorescent lamp crusher device, and more particularly to an improved, multipurpose such device which has the capability of accepting and crushing a variety of lamps of different types and shapes.

There currently are available in the marketplace prior art fluorescent lamp crushers, such as for example the types disclosed in U.S. Pat. No. 4,655,404, U.S. Pat. No. 5,205,497 and U.S. Pat. No. 5,575,429, each of which is owned by the Assignee of the present application. In addition to including means for filtering out mercury vapors released upon the destruction of fluorescent lamps, these various patents also disclose additional means for preventing leakage of such vapors into the atmosphere, and also means for automatically shutting down the associated crusher machine when the associated filter elements require replacement. However, with further development of the nature of gas or vapor filled lamps, it has become necessary to adapt such prior art machines to accommodate a variety of different types of lamps, such as mercury vapor, sodium pressure, metal haloid lamps, as well as more conventional flood and incandescent lamps. Moreover, since these lamps are now manufactured in a variety of different shapes, it is necessary for lamp crushers of the type described to provide means for accepting and safely crushing various such lamps.

Accordingly, it is an object of this invention to provide an improved lamp crusher of the type described which has a variety of differently shaped lamp feed chutes which communicate with the interior of the crusher machine.

Another object of this invention is to provide an improved such lamp crusher which is provided with various chute sealing devices which prevent any undesirable gas, vapors or glass particles from being discharged rearwardly in the feed chutes from the interior of the crusher housing.

Still another object of this invention is to provide a machine of the type described which has means for adjustably mounting the machine selectively above one of several waste drums into which crushed glass is discharged.

A further object of this invention is to provide for machines of the type described means for sensing the contents of an associated waste drum into which crushed lamps are disposed, and for automatically shutting down the machine when the contents of the drum reaches a predetermined level.

Still another object of this invention is to provide for a machine of the type described an improved crusher blade design which functions to crush glass into finer, nearly granular size, thereby permitting a large volume of lamps to be destroyed per waste drum.

Other objects of the invention will be apparent hereinafter from the specification and from the recital of the appended claims, particularly when read in conjunction with the accompanying drawings.

SUMMARY OF THE INVENTION

A lamp crusher housing is adjustably mounted on a wheeled rack to overlie the upper end of one, of a plurality of waste drums mounted on a pallet beneath the rack. The lower, discharge end of the housing is releasably and sealingly connected by a plastic sleeve to the upper end of the registering drum, so that glass fragments from lamps crushed in the housing drop through the sleeve to the drum.

A cover on the upper end of the housing is secured to the lower ends of three different chutes, each of which registers with an opening in the cover so that lamps fed into the upper ends of the chutes are free to drop through the chutes and into the housing where they are crushed by rotating crusher bars or flails. A vacuum pump or fan which is mounted on the outside of the housing communicates through a replaceable filter element with the interior of the housing adjacent its lower end.

One chute is circular in cross section and is designed to receive elongate fluorescent lamps of linear configuration; the second chute has an oblong, rectangular configuration for receiving circular and U-shaped fluorescent lamps; and the third chute is nearly square in cross section and is designed to receive and convey to the crusher housing mercury vapors, sodium pressure, metal haloid, flood and incandescent lamps. Each chute is normally closed at its upper end by a spring-loaded trap door, and the second and third chutes have mounted intermediate their ends flexible baffle elements extending transversely of the chute interiors to prevent glass particles and an air vortex from backing up in the chutes.

DETAILED DESCRIPTION OF THE PREFERRED EMBODIMENTS

Figure 1:
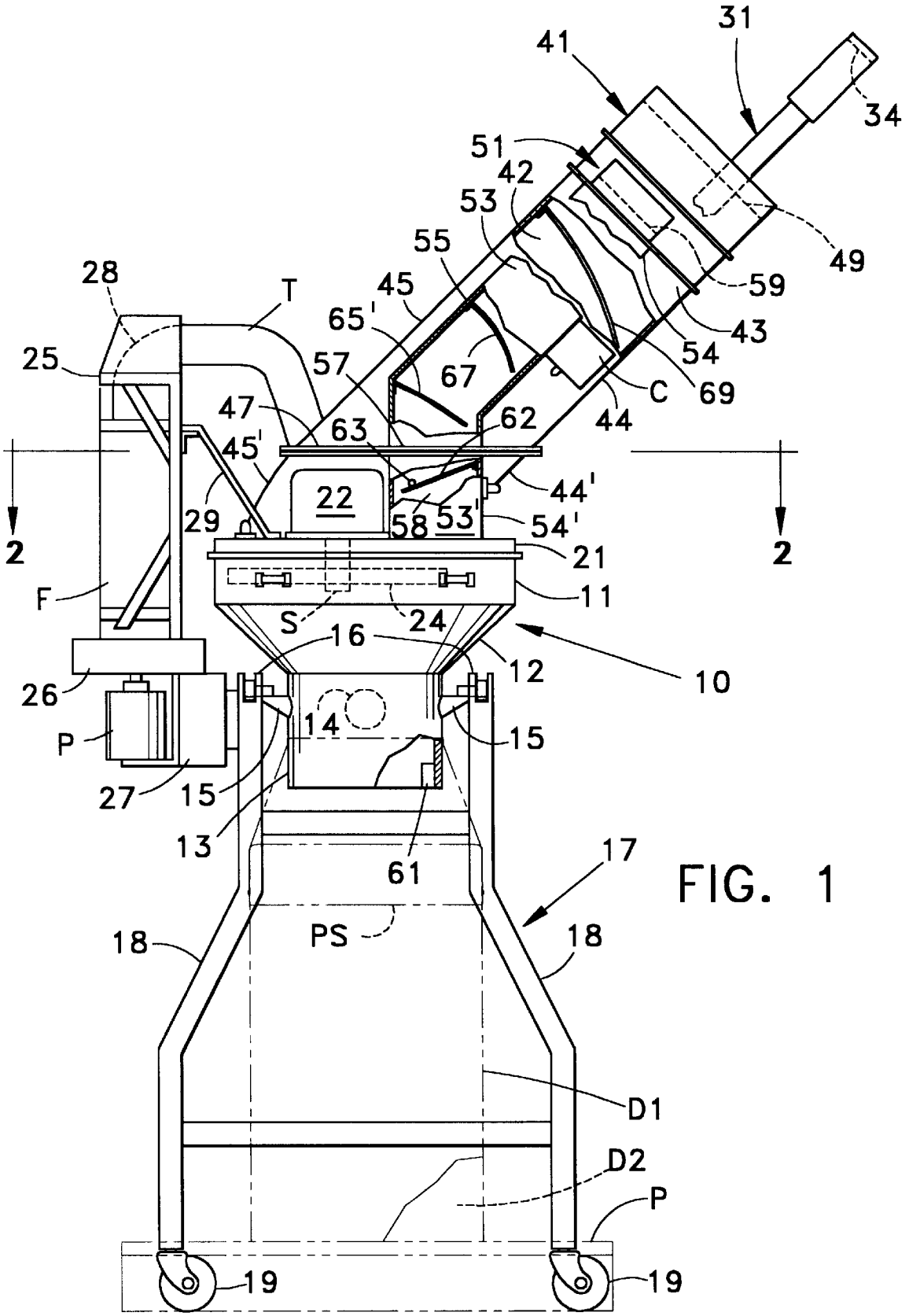
FIG. 1 is a side elevational view of an improved lamp crusher machine made according to one embodiment of this invention, the machine being shown as it appears when mounted on a wheeled rack and connected at its lower end by a plastic sleeve to one of two waste drums which are supported on a pallet beneath the rack, the plastic sleeve, waste drums and pallet being shown in phantom by broken lines, and portions of the machine being broken away and shown in section.
Figure 2:
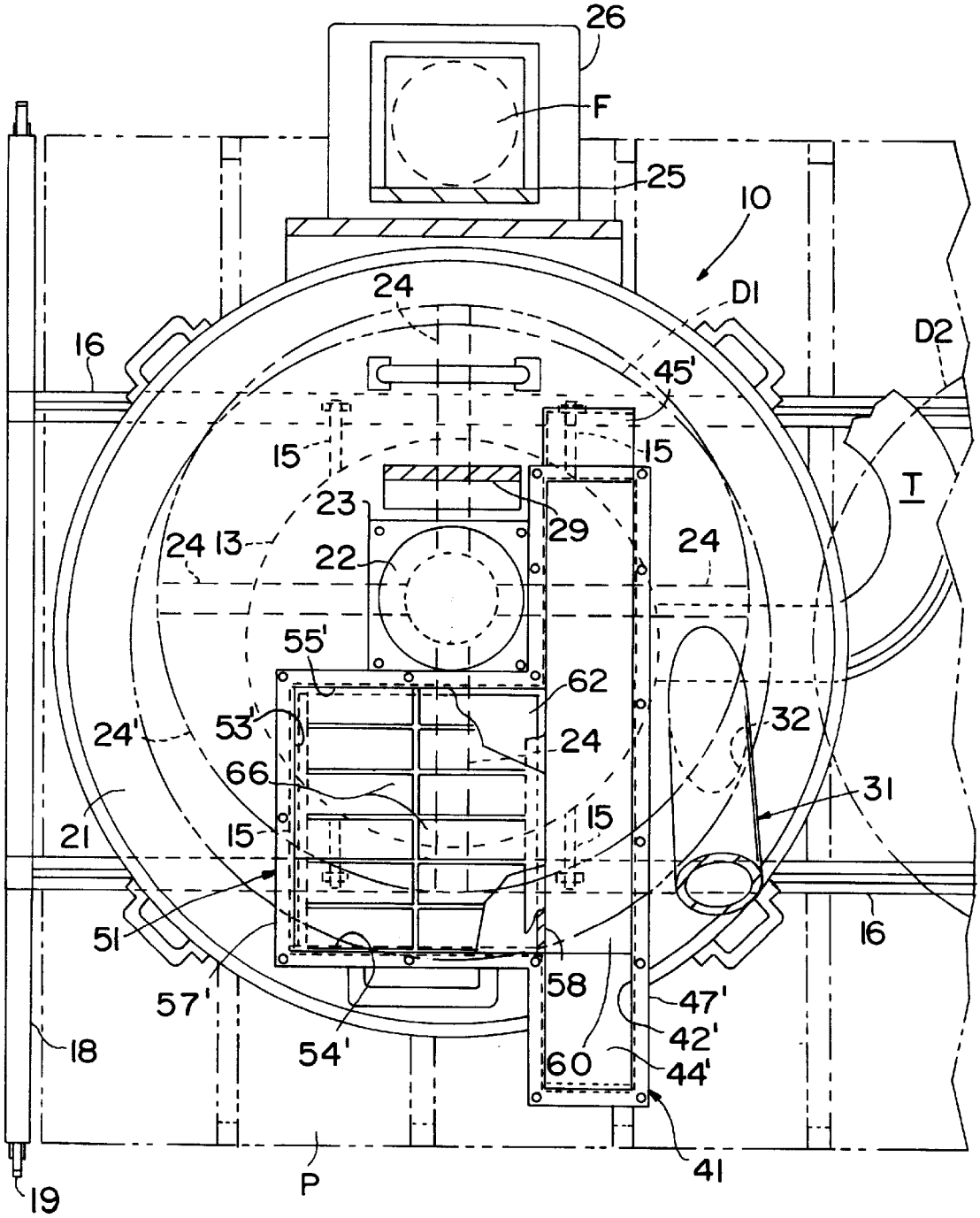
FIG. 2 is an enlarged fragmentary sectional view taken generally along the line 2—2 in FIG. 1 looking in the direction of the arrows, and with portions of the machine cut away and shown in section.

Referring now to FIGS. 1 and 2, 10 denotes generally a circular lamp crusher housing comprising an upper, annular wall section 11 which is integral at its lower end with the upper end of a downwardly tapered funnel section 12, the lower end of which has formed thereon an annular discharge section 13. Each of two sets of spaced brackets 15, which project from the outer surface of section 13 adjacent diametrally oppoisite sides thereof, are fastened to one of two spaced, parallel, horizontally disposed support bars 16 that form the upper end of a mobile support rack denoted generally by the numeral 17 (FIG. 1). Opposite ends 18 of the rack 17 are mounted on wheels 19, so that the rack 17 can be removably positioned over a couple of disposal drums D1 and D2 that are supported on a pallet P.

Secured over the upper, open end of housing 10 is a circular, metal cover 21. A motor 22, which is mounted on a plate 23 that is secured to the upper surface of cover 21, has a drive shaft S (FIG. 2) which extends downwardly through a registering opening in the cover 21 and into the cylindrical section 11 of housing 10 at a point just offset slightly in one direction from the centerline of housing 10. Releasably secured at their inner ends to the shaft S at 90 degree intervals thereabout, and projecting radially outwardly from the shaft are four, rigid, lamp crushing bars 24 the outer ends of which are disposed to travel in a circular path 24' (FIG. 2) in the housing section 11 when the shaft S is driven by the motor 22.

A flexible, air impervious tube T, which is connected at its lower end to an opening 14 (FIG. 1) in housing section 13, has its opposite end secured to the upper end of a filter carriage supporting bracket 25. Bracket 25 is secured at its lower end on blower housing 26 that projects from a motor support 27 that is secured to the rear of the rack support 17. The end of the tube T which is fixed to the bracket 25 is connected by a duct 28 to the upper end of a filter unit F, which contains a removable filter element, for example such as the type disclosed in U.S. Pat. No. 4,655,404. A suction fan motor P, which is mounted on support 27, drives a suction fan or blower, that is mounted in housing 26 and which is in communication with the interior of the filter unit F. As noted hereinafter, operation of motor P creates a vacuum in housing 10 to withdraw objectionable gases, vapors, particles and the like from the interior of the housing. To stabilize bracket 25 during the operation of the motor P, a bracket 29 is secured at one end to the cover 21 adjacent to motor 22, and is fastened at its opposite, upper end to the back of the bracket 25.

Secured at one end by welding, or the like, to the upper surface of cover 21, and with its lower end in registry with a circular opening 32 formed through cover 21 adjacent one peripheral edge thereof, is an elongate, tubular feed chute 31. Chute 31 has in its upper end a spring-loaded, normally-closed trap door 34, which is made of metal, and which is hinged along a portion of its edge to the inside of the chute to pivot into and out of its closed position. As noted more clearly in FIG. 1, for the majority of its length the tubular chute 31 is inclined approximately 45 degrees to the axial centerline of the opening 32 in cover 21.

Mounted adjacent to chute 31, and extending also for most of their lengths at an angle of approximately 45° to the center of the housing cover 21, are two additional lamp feed chutes that are denoted generally by the numerals 41 and 51, respectively. Chute 41 has an upper section which for most of its length is oblong rectangular in cross section, and is designed to feed into the crusher housing 10 U-shaped and circular lamps. Chute 51, which for most of its length is square in cross sectional configuration, is designed to supply mercury, vapor, sodium pressure, fluorescent incandescent and like lamps to the crusher housing 10.

As shown in FIG. 1, the upper section of chute 41 comprises two, spaced, parallel side walls 42 and 43 which are secured to or integral with spaced, parallel end walls 44 and 45. The upper section of chute 51 has one side wall thereof common with and formed by the sidewall 43 of chute 41. The other sidewall 53 of chute 51 is spaced from and extends parallel to the common sidewall 43, and is connected by a pair of spaced, parallel end walls 54 and 55 with the sidewall 43.

At its lower end the upper section of chute 41 has thereon an external, lateral flange section 47 projecting in a horizontal plane from its walls 42, 44 and 45, and from spaced portions of its wall 43. Adjacent its lower end the upper section of chute 51 extends vertically downwardly and likewise terminates in an external, lateral flange section 57 projecting from its walls 53, 54 and 55 in coplanar relation with flange 47. The common wall section 43 between chutes 41 and 51 terminates at the bottom of the upper sections of the chutes 41 and 51, and has a lower edge which is coplanar with the chute flanges 47 and 57. The flanges 47 and 57 register with, and are secured to, like flanges 47' and 57' (FIG. 2) which are secured to and bound the upper end of the lower sections of chutes 41 and 51, respectively.

The lower section of chute 41 is defined in part by the walls denoted by the numerals 42', 44' and 45', which constitute vertical extensions of the wall 42, 44 and 45, respectively; while the lower section of chute 51 comprises vertical extensions 53', 54' and 55' of the upper wall sections 53, 54, and 55, respectively. To separate the lower sections of chutes 41 and 51 from each other a rectangularly-shaped steel plate 58, which is nearly a mirror image of the sidewall 53', is secured along opposed edges thereof to the inner edges of walls 54' and 55' so that plate 58 registers with the lower edge of wall section 43 in spaced, parallel relation to wall 53'. The lower edges of the walls defining the lower sections of chutes 41 and 51 are secured by welding or the like sealingly against the upper surface of cover 21 around the opening 60 (FIG. 2) in the cover. This opening, is generally L-shaped in configuration so that it conforms to the open, lower ends of the lower sections of chutes 41 and 51. This enables lamps which are inserted into the upper ends of chutes 41 and 51 to pass through the opening 60 into the crushing section of housing 10, and into the path of the rotating bars 24, when the motor 22 is energized.

In use, the lower, cylindrical section 13 of housing 10 is releasably and sealingly connected by a plastic sleeve PS, such as for example the type disclosed in U.S. Pat. No. 5,205,497, to the upper end of the waste drum D1, which in the embodiment illustrated is positioned in registry with the lower, discharge end of housing 10. The operation of the crusher motor 22 and the motor P are controlled by electrical circuits enclosed in a controller unit C, which is mounted centrally on the wall 54 of chute 51. When the motor P and crusher motor 22 are in operation, lamps, depending upon the particular shape thereof, may be inserted selectively into the upper ends of any one of the chutes 31, 41 and 51. The lamps that are to be crushed pass downwardly through the respective chutes, and through the opening 60 in cover 21 into the path of the rotating crusher bars 24, which then grind the lamps into small particles that drop downwardly through the bottom of crusher housing 10 and into the registering drum D1.

Like chute 31, the chutes 41 and 51 have mounted in their upper ends spring-loaded metal trap doors 49 and 59, respectively, which are rectangular in configuration and are hinged along one edge thereof to the inside of the associated chute. After a lamp has been inserted into a respective chute 41 or 51, and has passed beyond the associated trap door 49 or 59, such door automatically closes to seal the upper end of the respective chute 41 or 51. This enables the motor P to maintain in chutes 41 and 51 the suction or vacuum described above. Because the lower ends of the chutes 31, 41 and 51 are in communication with the interior of the crusher housing 10, the vacuum created in this housing by motor P also is maintained at the lower ends of the chutes and hence to the interiors thereof.

The controller unit C also controls a sensing device 61, which is mounted in the lower, cylindrical section 13 of the housing 10 in order to sense when the associated waste drum D1 has been filled. This sensing device 61, which may be in the form of an ultrasonic sensor enclosed within a sealed housing in a device 61, detects when the drum D1 is filled, and at such time applies a signal to a counter circuit which automatically shuts down further operation of the machine—i.e., interrupt the operation of motor 22 and motor P, when a predetermined number of drums have been filled. This enables the filter element of filter unit F to be replaced In order to make sure that small bulbs entering the lower section of chute 51 are conveyed into the path of the rotating flails or crushing bars 24 a spring-loaded steel damper door or plate 62 is pivotally mounted along one edge thereof (the upper edge in FIG. 1) to the inside of the chute wall 54' beneath its upper edge. Plate 62 extends diagonally downwardly at approximately 45° from wall 54' and part way across the interior of the lower section of chute 51. Torsion springs or the like normally urge plate 62 resiliently into a position of rest in which the plate engages a stop pin 63 (FIG. 1) that extends through wall or plate 58 to overlie the upper (FIG. 1) surface of plate 62. Bulbs dropping onto plate 62 may, if necessary, cause plate 62 to pivot downwardly against the resistance of its associated springs from its position as shown in FIG. 1.

During operation of the crusher unit glass particles and the vortex created in housing 10 have a tendency to back up into the lower ends of the chutes 41 and 51. To prevent undesirable entry of such particles and vortex into the upper section of the chute 51, two sets of spaced, parallel, flexible baffle elements 66 are mounted to extend across the upper end of the lower section of chute 51. For example, as shown in FIG. 2, six such elements 66 of each set are secured at one of their ends to the upper edges of walls 53' and 58, respectively, and project at their opposite ends part way across the chute into confronting, partly overlapping relation to each other.

Also, a solid, flexible baffle 65' is secured at one end to the chute wall 55 adjacent its juncture with wall 55', and extends part way across the interior of chute 51 above the elements 66; and each of a set of five, spaced, parallel, flexible baffles 67 is secured at one end thereof to chute wall 55 above the baffle 65' and extends part way across chute 51.

In chute 41, one flexible baffle element 69 is secured at one end to the chute wall 45 adjacent the upper end of chute 41 and extends part way across the interior of chute 41.

By way of example, the flexible baffle 65' may be made from a thick piece of rubber which normally is free to bend part way downwardly in chute 51 relative to its upper or left-hand edge, which as shown in FIG. 1 is secured along its length to the inside surface of the chute wall 55. The lower portion of the baffle element 65' is therefore free to bend downwardly when engaged by an incoming lamp; and after the lamp has passed the element will tend to return to the position as shown in FIG. 1. Likewise, the set of spaced, parallel, flexible baffle elements 67 are also free to hang slightly downwardly in the chute 51 above element 65', and when engaged by an incoming lamp, also are free to bend further downwardly into the chute 51 to permit passage of the incoming lamp or lamps. Elements 67 then tend to return to their positions as shown in FIG. 1, wherein, like element 65', they tend to prevent pieces of glass and the vortex that is generated in housing 10 from backing upwardly into the chute 51. Baffle elements 67 can be created by slitting a rectangular piece of rubber along parallel lines extending normal to the edge of the baffle set which is fastened to wall 55. Likewise, the flexible baffle element 69 may be made from a strip of rubber material which is free to bend downwardly in chute 41 relative to its fixed, upper edge, and like the baffle elements 65' and 67 functions to prevent any undesirable particles of glass and the vortex in housing 10 from backing upwardly into the upper end of chute 41.

When the machine is operating and the vacuum is generated in the lower end of housing 10, the free ends of the two sets of baffle element 66, which also may be made from strips of rubber, are free to bend downwardly in the lower section of chute 51 relative to the fixed edges thereof. In FIG. 2 the free ends of the baffle element 66 are shown as they appear when they are bent slightly downwardly, thus creating a slight space between the confronting ends thereof. In practice, however, one set of baffle element 66 is made slightly longer than the other, so that when the machine is not operating, the confronting ends of elements 66 slightly overlap one another.

Also, to help maintain the spring-loaded trap doors 34, 49 and 59 in their closed positions, a strip of flexible magnetic material may be mounted on the inside of each chute to engage marginal edge portions of the respective doors when they are in their closed positions. The baffle elements 66 not only prevent glass particles from passing upwardly into the chute 51, but also help to prevent the circulating air or vortex generated within housing 10 from backing upwardly into the chute 15.

From the foregoing it will be apparent that the present invention provides very effective means for permitting a large variety of lamps of different sizes, shapes and composition to be crushed and disposed of in a single machine. The three chutes 31, 41 and 51 include in their upper ends spring-loaded trap doors which normally remain closed; and chutes 41 and 51 include the additional baffle elements 66, 65', 67 and 69 which prevent any undesirable backup of glass particles and vortex into the chutes 41 and 51. Moreover, the spring-loaded damper door or plate 62 in the lower section of chute 51 guides small incoming bulbs directly into the path of the rotating crusher members 24 in housing 10. The rigid crusher members 24 are releasably secured at their inner ends to a hub on shaft S so that they can easily be replaced, and in operation grind the incoming glass into finer particles than prior such flails, thereby permitting a larger quantity of crushed bulbs to be stored in a respective disposal drum D1 or D2. Also, when drum D1 becomes filled, as evidenced by a signal generated by the switch 61, the brackets 15 can be disconnected from their illustrated positions on the support bars 16, and may be shifted laterally to position the crusher housing 10 over the other drum D2, which then is connected by a plastic sleeve PS to the discharge end of housing 10. This considerably expedites the crushing of lamps. Likewise, of course, the wheel mounted rack 17 permits the rack and the crusher housing 10 supported thereon to be easily transported to and from a pallet P on which the drums D1 and D2 are supported.

Although in the illustrated embodiments flexible baffle elements have not been illustrated in chute 31, it will be apparent that one or more such elements may be installed in chute 31 without departing from this invention.

While this invention has been illustrated and described in detail in connection with only certain embodiments thereof, it will be apparent that it is capable of still further modification, and that this application is intended to cover any such modifications that may fall within the scope of one skilled in the art or the appended claims.

I claim:

1. A multipurpose lamp crusher for differently shaped lamps, comprising a housing having an upper end, a lower end, and a central opening extending between said ends, a cover secured on the upper end of said housing to close the upper end of said central opening, said cover having therethrough a plurality of differently shaped access openings communicating with said central opening in said housing, a plurality of lamp crusher members mounted in said housing for rotation in said central opening intermediate the ends thereof, a plurality of differently shaped lamp supply chutes secured to and extending above said cover, each of said chutes having a lower end similar in shape to and registering with one of said access openings in said cover, and having an upper end into which lamps of a predetermined shape are disposed to be inserted for delivery through a respective chute and registering access opening into the path the rotating crusher member in said housing, vacuum filter means connected to said central opening in said housing and operative to maintain a vacuum in said housing to withdraw therefrom toxic gases released upon the crushing of lamps in said housing, and flexible baffle means mounted in certain of said chutes intermediate the ends thereof to prevent glass particles from crushed lamps from backing up from said housing into said certain chutes.

2. A multipurpose lamp crusher as defined in claim 1, including a spring-loaded trap door pivotally mounted in each of said chutes adjacent the upper end thereof, and operative normally to extend transversely across the interior of the associated chute to close the upper end thereof, and being engageable by an incoming lamp to be pivoted thereby momentarily into an open position relative the interior of the associated chute.

3. A multipurpose lamp crusher as defined in claim 2, wherein in said certain chutes said flexible baffle means are located between the trap door and the lower end of the associated chute.

4. A multipurpose lamp crusher as defined in claim 1, wherein said flexible baffle means in each of said certain chutes comprises a flexible baffle element secured at one end thereof to the inside of its associated chute above the lower end thereof, and projecting at its opposite end transversely and part way across the interior of its associated chute to be engaged by and to be flexed momentarily downwardly in such chute by any lamp passing downwardly through the last-named chute.

5. A multipurpose lamp crusher as defined in claim 4, wherein one of said baffle elements has a plurality of spaced, parallel slits formed therein and extending from said opposite end thereof toward said one end thereof.

6. A multipurpose lamp crusher as defined in claim 4, wherein said flexible baffle means in one of said certain chutes further comprises a further plurality of flexible baffle elements secured on said cover at the lower end of said one chute, and each of said further plurality of baffle elements extending part way over the cover access opening with which said lower end of said one chute registers.

7. A multipurpose lamp crusher as defined in claim 6, including a lamp deflector plate pivotally mounted along one edge thereof to the inside surface of said one chute above said further plurality of baffle elements for limited pivotal movement by an incoming lamp momentarily downwardly from a normal position of rest in which said plate extends diagonally downwardly and part way across the interior of said one chute.

8. A multipurpose lamp crusher as defined in claim 1, wherein there are at least three chutes secured to and extending above said cover, one of said chutes being generally circular in cross section, and each of two others of said chutes being generally rectangular in cross section.

9. A multipurpose lamp crusher as defined in claim 8, wherein said flexible baffle means comprises, at least one flexible baffle element mounted in each of said two others of said chutes intermediate the ends thereof, and each of said baffle elements being secured at one end thereof to the inside of the chute associated therewith, and extending at its opposite end transversely of and part way across the inside of its associated chute.

10. A multipurpose lamp crusher as defined in claim 9, wherein a plurality of said flexible baffle elements are mounted in one of said two others of said chutes in longitudinally spaced relation to each other intermediate the ends of the last-named chute.

11. A multipurpose lamp crusher as defined in claim 1, including means for supporting said housing above and in registry with the upper, open end of a waste collector, means releasably and sealingly connecting the lower end of said housing to the upper end of said waste collector to guide crushed glass particles into said collector, and means for sensing when said collector has been filled with glass particles.

12. A multipurpose lamp crusher as defined in claim 11, wherein said housing supporting means comprises, a rack disposed to support said housing above and selectively in registry with the upper end of one of a plurality of said waste receptacles, and means for releasably attaching said housing on said rack and operable selectively to enable said housing to be shifted into different operative positions on said rack and into registry with different ones of said waste collectors.

13. A multipurpose lamp crusher assembly, comprising a plurality of differently shaped lamp feed chutes secured at their lower ends to the upper end of a lamp crusher housing to communicate with the interior thereof, said chutes being disposed to have differently shaped lamps inserted into their upper ends to be conveyed thereby downwardly and into the path of rotating crusher members in said crusher housing to be crushed thereby, a rack for supporting said housing thereon with a discharge opening in the lower end of the housing positioned over and in communication with one of a plurality of waste collectors positioned beneath said rack to collect crushed glass particles which drop from said discharge opening of said housing when lamps are crushed therein, and means for removably and adjustably mounting said housing on said rack, whereby when said one waste collector has been filled with crushed glass said housing may be adjusted on said rack into a different position to place the discharge end there in registry with another, empty waste collector.

14. A multipurpose lamp crusher assembly as defined in claim 13, including a plurality of flexible baffle elements interposed between the lower end of one of said chutes and the interior of said housing, and operative to permit incoming lamps to pass from said one chute to said interior of the housing, and to prevent crushed glass particles from backing up from inside the housing and into said one chute.

15. A multipurpose lamp crusher assembly as defined in claim 14, wherein said rack is mounted at its lower end on a plurality of wheels which permit said rack and housing to be wheeled to and from registry with said waste collectors.

16. A multipurpose lamp crusher assembly as defined in claim 14 including a spring-loaded deflector plate mounted in said one chute between said upper end thereof and said baffle elements, said deflector plate being pivotally connected along one edge thereof to the inside of said one chute and extending at its opposite end diagonally downwardly and transversely of and part way across the interior of said one chute.

17. A multipurpose lamp crusher assembly as defined in claim 16, including a spring-loaded trap door pivotally mounted in each of said chutes adjacent the upper end thereof and operative normally to extend transversely across the interior of the associated chute to seal the upper end thereof.

18. A multipurpose lamp crusher assembly as defined in claim 17, wherein each of at least certain of said chutes has mounted therein, between its lower end and its associated trap door, means for preventing any vortex and crushed glass particles from backing up from the interior of said housing to the interiors of said certain chutes.

19. A multipurpose lamp crusher assembly as defined in claim 18, wherein there are at least three of said feed chutes secured at their lower ends to the upper end of said housing and each of said chutes has a different cross sectional configuration.

* * * * *